United States Patent [19]

Wulff

[11] 4,403,440

[45] Sep. 13, 1983

[54] TOY VEHICLE ACCELERATOR

[75] Inventor: Virgil W. Wulff, Fullerton, Calif.

[73] Assignee: Mattel, Inc., Hawthorne, Calif.

[21] Appl. No.: 312,440

[22] Filed: Oct. 19, 1981

[51] Int. Cl.[3] ..... A63H 33/00; A63H 29/00

[52] U.S. Cl. ..... 46/1 K; 273/129 S

[58] Field of Search ..... 46/1 K, 202, 206; 124/21, 26; 273/129 S, 129 T

[56] References Cited

U.S. PATENT DOCUMENTS 2,522,160 9/1950 Borchers ..... 273/129 S X 4,108,437 8/1978 DeAnda et al. ..... 46/1 K X

FOREIGN PATENT DOCUMENTS 2031426 11/1979 Fed. Rep. of Germany ..... 46/1 K

*Primary Examiner*—Robert P. Swiatek

*Attorney, Agent, or Firm*—Reagin & King

[57] ABSTRACT

A toy vehicle accelerator is disclosed which includes a housing, an opening in the housing of a width to fit a particular toy vehicle, and an impeller mounted to slide in the opening as well as to rotate freely in a horizontal plane. The impeller includes surfaces which contact a properly sized vehicle and permit the impeller to accelerate that vehicle. An improperly sized object merely causes the impeller to rotate, precluding the acceleration of such objects.

7 Claims, 9 Drawing Figures

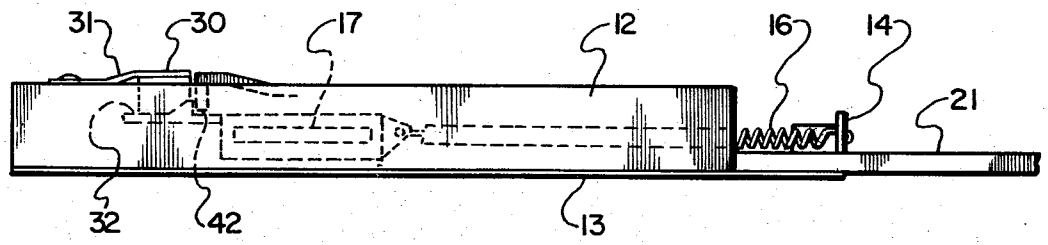
Fig. 2.
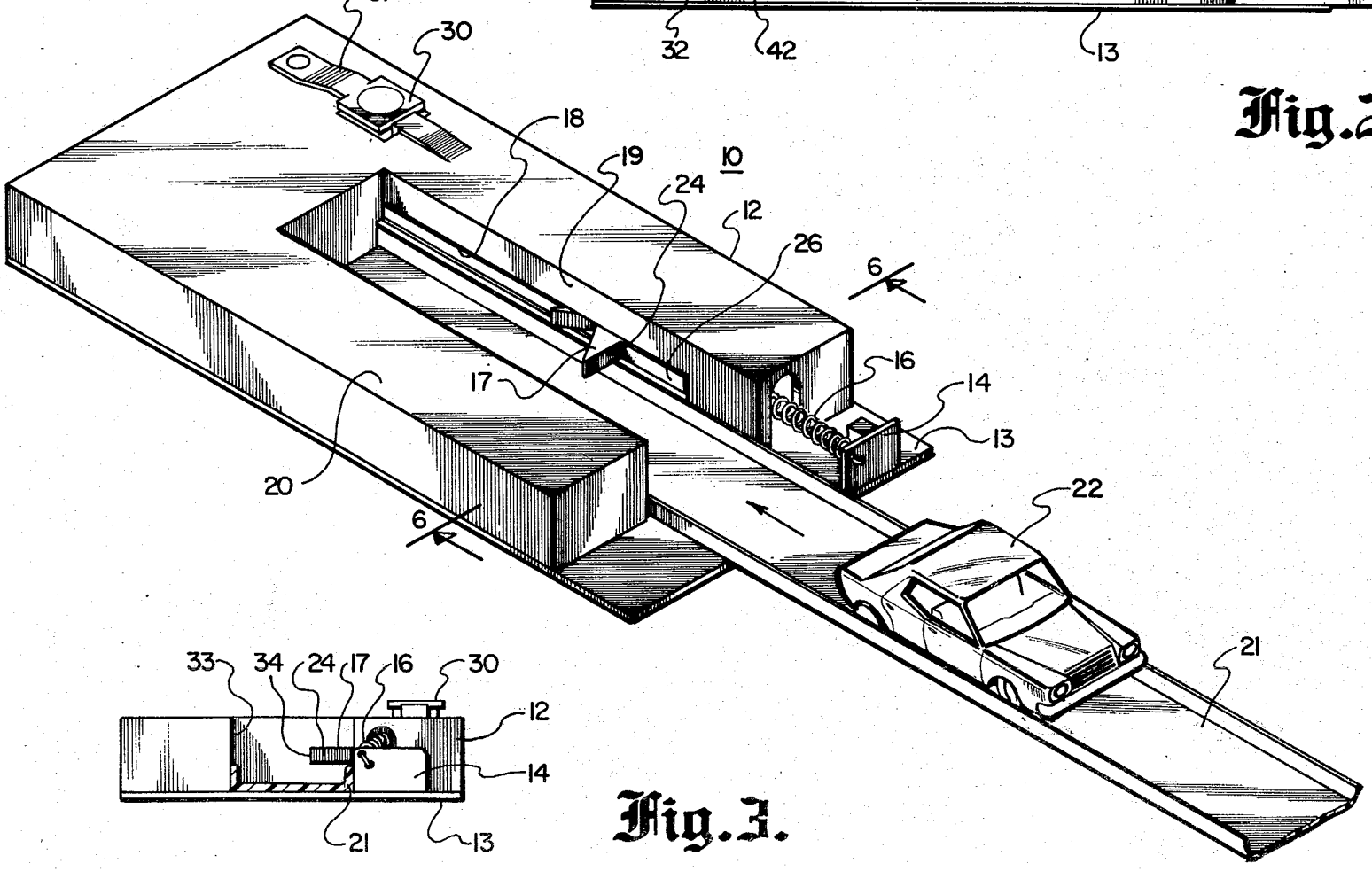
Fig. 1.
Fig. 3.

Fig.7.
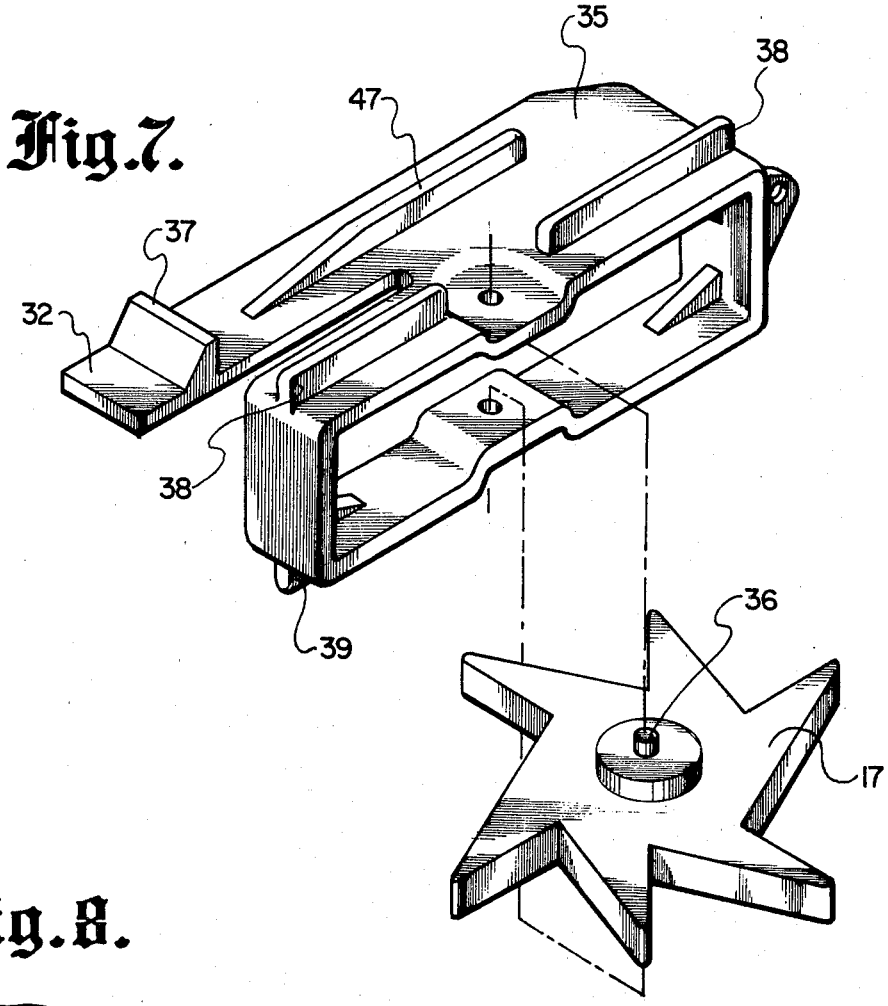
Fig.8.
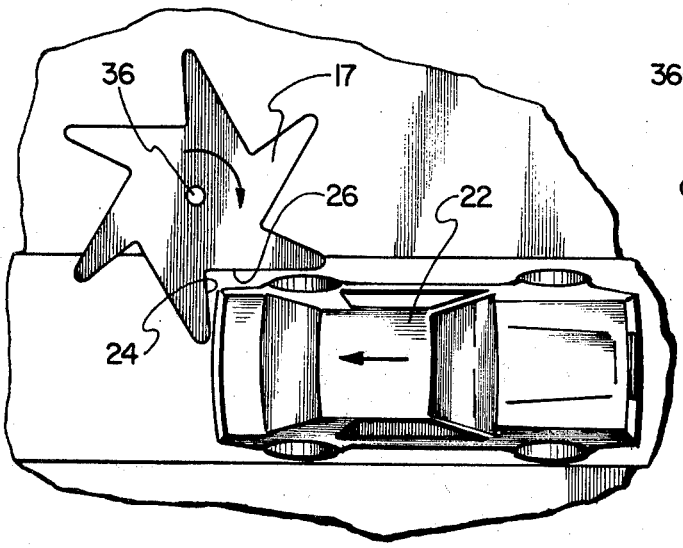
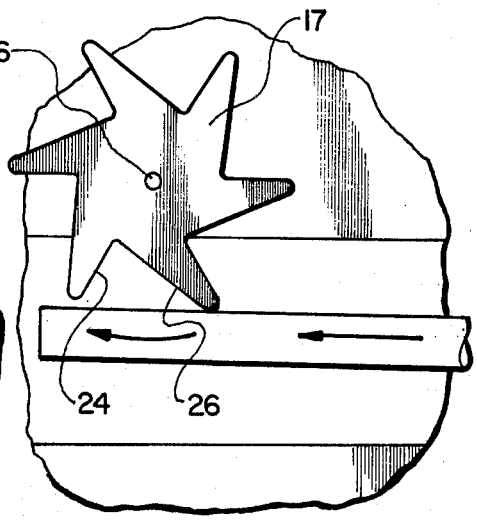
Fig.9.

TOY VEHICLE ACCELERATOR

BACKGROUND OF THE INVENTION

This invention relates to toys and, more particularly, to toy vehicle accelerators.

A toy vehicle accelerator is a device used for imparting a high initial velocity to an unpowered toy vehicle so that the vehicle may be raced or run through some form of toy track layout. In general, such accelerators impart velocity to a toy vehicle by first gripping the vehicle, next accelerating while holding the vehicle, and finally releasing the vehicle so that it continues with a speed which is initially equal to that of the accelerator. Examples of such toy vehicle accelerators known to the prior art are shown in U.S. Pat. Nos. 3,641,704, 3,777,391, and 3,877,169.

Many such accelerators function much like slingshots. And like slingshots most toy vehicle accelerators may be used to accelerate, in addition to toy vehicles, various objects which may be dangerous to the operator or bystanders. For example, pencils and other pointed objects may be accelerated to substantial velocities by many such accelerators.

It is, therefore, an object of this invention to provide a new and improved toy vehicle accelerator.

It is another object of this invention to provide a toy vehicle accelerator which is difficult to use for projecting anything other than the vehicles especially designed for use with the accelerator.

SUMMARY OF THE INVENTION

These and other objects of the invention are accomplished by an accelerator which includes a housing, an opening in the housing of a width to fit a particular toy vehicle, an impeller mounted to slide in the opening and adapted to abut a toy vehicle therein on at least two sides, means rotatably mounting the impeller, and means for moving the impeller in the opening whereby a vehicle in the opening may be propelled therefrom. The rotatably mounted impeller merely rotates and refuses to propel any object placed in the opening which does not correctly fit the opening.

Other objects, features, and advantages of the invention will become apparent from a reading of the specification when taken in conjunction with the drawing in which like reference numerals refer to like elements in the several views.

DESCRIPTION OF THE DRAWINGS

FIG. 1 is a perspective view of an accelerator used for imparting high initial velocity to toy vehicles in accordance with the invention;

FIG. 2 is a side view of the accelerator shown in FIG. 1;

FIG. 3 is a front view of the accelerator shown in FIG. 1;

FIG. 7 is an exploded perspective view of a detail of the invention shown in FIG. 1; and FIGS. 8 and 9 are top views of details of the invention shown in FIG. 1.

DESCRIPTION OF THE PREFERRED EMBODIMENT

Figure 4:
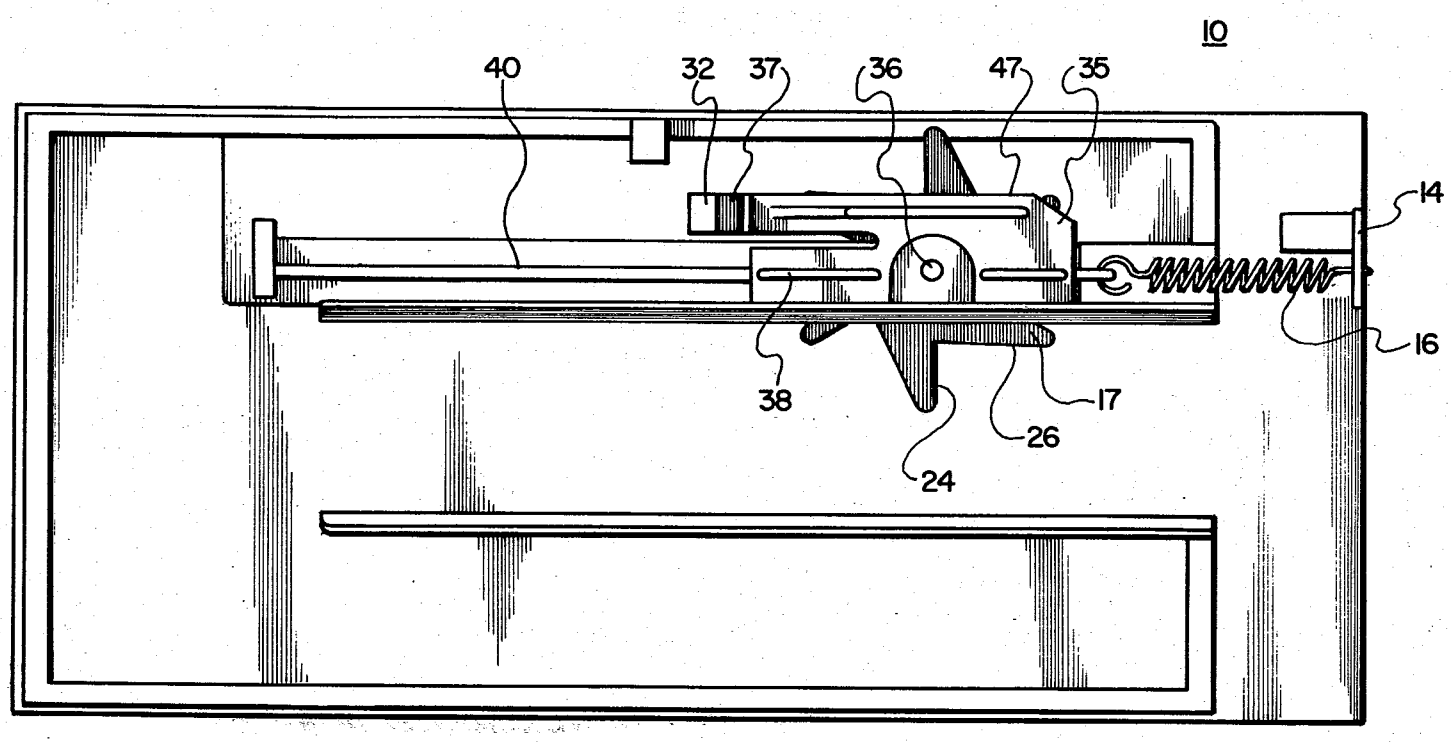
FIG. 4 is a top view of the interior of the accelerator shown in FIG. 1.

Referring now to the drawings and, more particularly, to FIG. 1, there is shown an accelerator 10 for a toy vehicle constructed in accordance with the invention. The accelerator 10 includes a housing 12 which covers a base 13. At one end of the base 13 is an upstanding tab 14 to which is connected one end of a spring 16. The other end of the spring 16 is attached to a mount 35 (see FIGS. 4, 5 and 7) for an impeller 17 having a star-like configuration (see FIGS. 7, 8 and 9) in the preferred embodiment.

As will be understood from the description which follows, the impeller 17 is mounted to project through and slide in a slot 18 in a wall 19 on an interior surface of the housing 12. As may be seen in FIG. 1, the housing 12 has a generally U-shaped top surface 20 and walls projecting downwardly from the surface 20 to abut the base 13. The wall 19 is but one of three interior walls of the housing 12 which form an opening shaped to fit the end of a track piece 21. The track piece 21 is fixed to the base 13. A toy vehicle 22 is adapted to fit the track piece 21.

When the toy vehicle 22 is moved by the operator against the impeller 17 in the direction shown by the arrows in FIGS. 1 and 8, it moves against a surface 24 thereof and attempts to move that surface 24 in the direction of the arrow. As will be understood from the description which follows, the impeller 17 is mounted in such a way that it tends to rotate about a pivot position within the housing 12. That pivot position moves with the impeller 17 along a line parallel to the long axis of the track piece 21. The pivoting of the impeller 17 causes a second surface 26 thereof to be urged (by pressure upon the surface 24) against the left side of a vehicle 22 pushing upon the surface 24. As the surface 26 contacts the vehicle 22, the impeller 17 ceases its rotation upon its pivot and is driven backward against the pull of the spring 16 in the direction of the arrow in FIG. 1 thereby acquiring potential energy from the spring 16. When the impeller 17 is released, the impeller 17 is pulled by the spring 16 in a direction opposite to the arrow in FIG. 1 and propels the vehicle 22 in that direction along the track piece 21.

If an object other than the vehicle 22 is placed in the recess or opening in the housing 12 in such a way as to move the impeller surface 24 in the direction of the arrow shown in FIG. 1, the impeller 17 rotates upon its pivot. Unless that object is of such a shape that the surface 26 immediately comes in contact with the side of the object, the impeller 17 merely spins, allows the object to pass (see FIG. 9), and is not driven in the direction of the arrow in FIG. 1. Consequently, most objects can not be propelled out of the accelerator 10. Only objects having a shape approximating that of the vehicle 22 cause the impeller 17 to move to the rear of the recess in the housing 12 thereby storing energy in the stretched spring 16. Consequently, pencils and other objects of that nature can not be propelled out of the accelerator 10.

To the rear of the accelerator 10 shown in FIG. 1 is a button 30 which may be depressed to release a locking device which locks the impeller 17 in its rear position ready to be released to propel the vehicle 22 from the accelerator 10. The button 30 is mounted to the top surface of the housing 12 (in the embodiment shown in FIG. 1) by means such as a rivet or other fastener and has an arm 31 which acts as a spring against the force applied on the button 30 so that the button 30 moves upward after it has been released. The lower surface of the button 30 pushes against a surface 32 (see FIG. 7) extending from a mount 35. As the surface 32 moves downward, it carries with it a projection 37 which is thereby released from spring engagement with a projection 42 extending downwardly from the surface 20 of housing 12. The projection 42 engages the projection 37 to hold the mount 35 and the impeller 17 in the loaded position when a vehicle is pressed against the impeller 17.

FIGS. 2 and 3 show other views of the various portions of the accelerator 10 which have been described previously. FIG. 3 is especially valuable in illustrating that any object which is narrower than the dimension between a wall 33 and an end 34 of the surface 24 merely causes the impeller 17 to rotate and therefore can not be projected by the accelerator 10.

Figure 5:
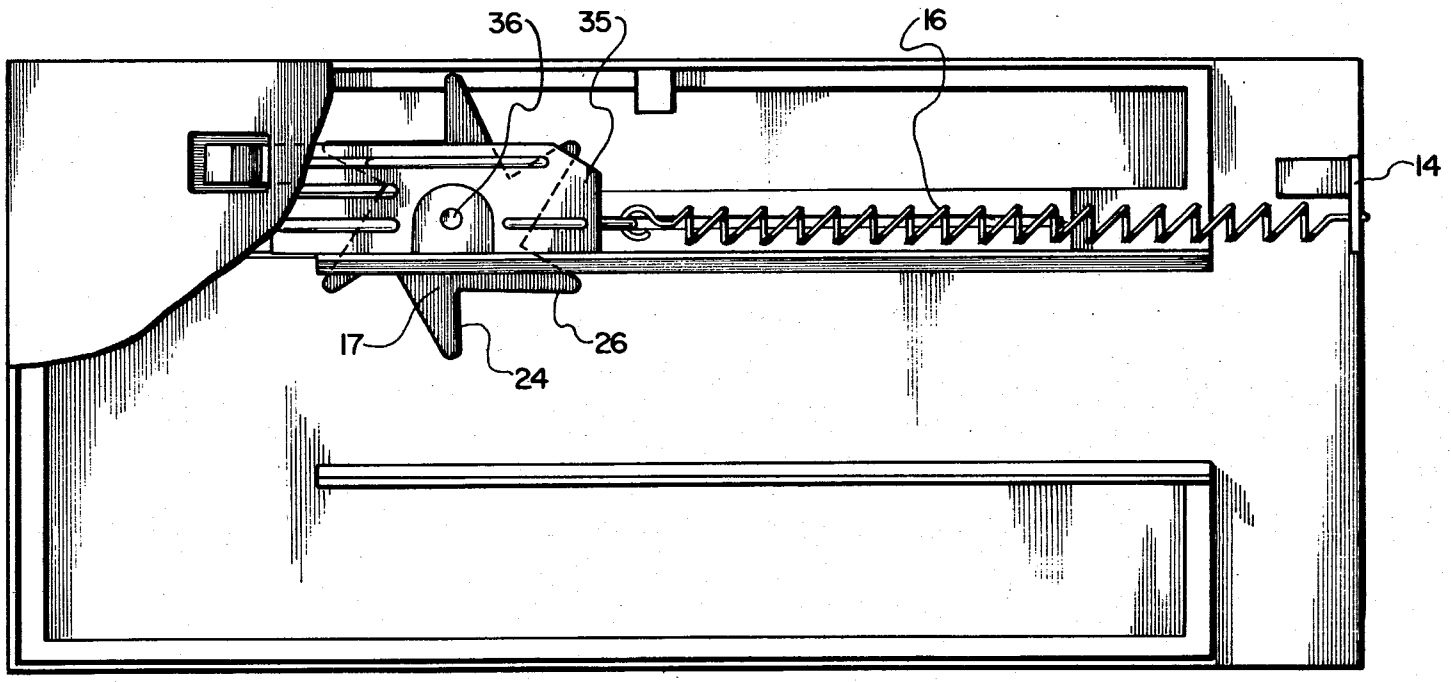
FIG. 5 is a top view, partially cut away, of the accelerator shown in FIG. 1.
Figure 6:
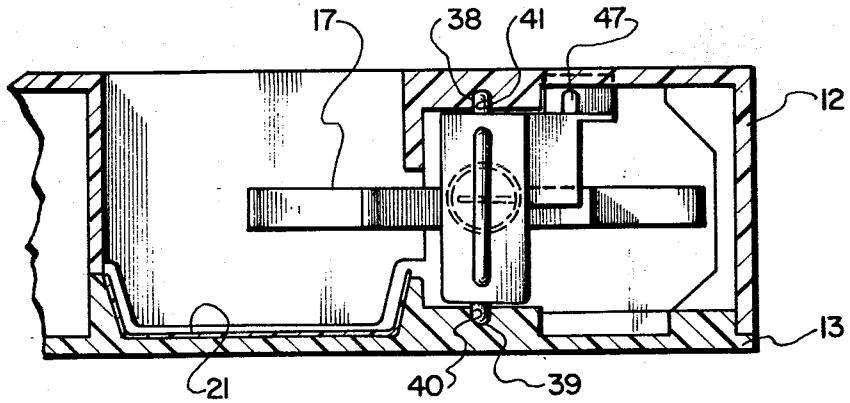
FIG. 6 is an end view of a portion of the interior of the accelerator shown in FIG. 1.

FIG. 4 illustrates the internal mechanism within the housing 12 of the accelerator 10. As may be seen in FIG. 4, the spring 16 is connected at its right end to the tab 14 and at its left end to the mount 35 to which the impeller 17 is rotatably attached at a pivot 36. The mount 35 has rails 38 which project upwardly therefrom and fit in a track 41 on the interior upper surface of housing 12. Similar rails 39 (see FIG. 6) extend from the bottom of the mount 35 and are adapted to fit within a track 40 on the upper surface of the base 13 covered by the housing 12. The rails 38 and 39 and the tracks 40 and 41 assure that the mount 35 travels in its movement in a straight line along the longitudinal axis of the spring 16.

As may be seen from FIGS. 7, 8, and 9, the impeller 17 is essentially star shaped and rotates about the pivot 36. A different number of points might be used in another embodiment of the impeller 17, but this number allows a vehicle to engage the impeller 17 without manipulation.

The preferred embodiment of the invention also includes tab 47 which projects upwardly from the mount 35 (see FIG. 6) and bears against the upper inner surface of the housing 12 thereby prohibiting the mount 35 and the impeller 17 from rotating along a horizontal axis extending through the spring 16 and thereby binding against the housing 12 or the base 13.

Most of the components of the accelerator 10 may be constructed of moldable plastic materials well known to the prior art which are especially adapted to form the intricate shapes necessary to this invention. Various of the components such as spring 16 may be constructed of material such as spring steel in a manner well known to the art.

As will be obvious to those skilled in the art, the accelerator 10 provided by this invention is especially safe for use by small children and is so designed as to substantially reduce the possibility of harm to the operator and bystanders. While a preferred embodiment of the invention has been shown and described, it is to be understood that various other adaptations and modifications might be made within the spirit and scope of the invention.

What is claimed is:

1. A toy vehicle accelerator comprising a track piece; a pair of essentially parallel walls on opposite sides of the track piece separated by a distance selected to fit a particular size of toy vehicle; an impeller rotatably positioned to intrude over the track piece, the impeller being mounted to rotate freely in a horizontal plane and having first and second surfaces arranged so that when the first surface contacts the front or rear of a selected toy vehicle placed on the track piece the second surface contacts a side of the vehicle; and means for moving the impeller along the track piece.

2. A toy vehicle accelerator as in claim 1 in which the means for moving the impeller along the track piece comprises a mount for the impeller, means constraining the mount to move parallel to the track piece, and means for moving the mount.

3. A toy vehicle accelerator as in claim 2 in which the means for moving the mount comprises a means for attaching a spring fixed with respect to the track piece, and a spring fastened to the mount and the means for attaching a spring.

4. A toy vehicle accelerator as in claim 3 in which the pair of essentially parallel walls are defined by a housing, and in which the mount for the impeller is positioned within the housing.

5. A toy vehicle accelerator as in claim 1 further comprising additional pairs of surfaces on the impeller arranged to contact surfaces of selected toy vehicles in different positions of the impeller.

6. A toy vehicle accelerator comprising:

a track piece;

a pair of essentially parallel walls on opposite sides of the track piece separated by a distance selected to fit a particular size of a toy vehicle;

an impeller rotatably positioned to intrude over the track piece, the impeller having first and second surfaces arranged so that when the first surface contacts the front or rear of a selected toy vehicle placed on the track piece the second surface contacts a side of the vehicle;

means for moving the impeller along the track piece;

said means for moving the impeller along the track piece comprising:

a mount for the impeller;

means constraining the mount to move parallel to the track piece;

means for moving the mount;

said means for moving the mount comprising:

means for attaching a spring fixed with respect to the track piece;

a spring fastened to the mount and the means for attaching a spring;

a housing defining said pair of essentially parallel walls, the mount for the impeller being positioned within the housing; and said mount including a spring mounted projection, a second projection protruding from the housing to engage the spring mounted projection in the loaded position of the spring and means for disengaging the two projections.

7. In combination with a track piece having at least one upstanding sidewall and a toy vehicle adapted to move along said track piece adjacent said sidewall, an accelerator comprising:

means for impelling said vehicle along said track piece, said impelling means having at least two radially-extending surfaces, said surfaces being arranged in a manner such that when one surface engages the rear of said toy vehicle, the other surface engages one side of said vehicle;

means mounting said impelling means for rotation in a horizontal plane above said track piece and for reciprocating movement along that edge of said track piece which is opposite the edge carrying said sidewall;

means for biasing said mounting means toward one end of said track piece; and means for releasably latching said mounting means adjacent the other end of said track piece, whereby said vehicle may be used to load said biasing means by placing the rear of said vehicle against said one surface with sufficient force to cause said impelling means to rotate until said other surface engages the side of said vehicle which is adjacent said impelling means so that said impelling means will be prevented from rotating and said mounting means will move to a latched position at said other end of said track piece upon continued force being applied to said vehicle.

* * * * *